US009280072B2

(12) United States Patent
Ogaki et al.

(10) Patent No.: US 9,280,072 B2
(45) Date of Patent: Mar. 8, 2016

(54) PROCESS FOR PRODUCING ELECTROPHOTOGRAPHIC PHOTOSENSITIVE MEMBER

(71) Applicant: CANON KABUSHIKI KAISHA, Tokyo (JP)

(72) Inventors: Harunobu Ogaki, Suntou-gun (JP); Atsushi Okuda, Yokohama (JP); Kunihiko Sekido, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/295,989

(22) Filed: Jun. 4, 2014

(65) Prior Publication Data

US 2014/0377703 A1 Dec. 25, 2014

(30) Foreign Application Priority Data

Jun. 19, 2013 (JP) ..... 2013-128287

(51) Int. Cl.
*G03G 5/14* (2006.01)
*G03G 5/05* (2006.01)

(52) U.S. Cl.
CPC ..... *G03G 5/14* (2013.01); *G03G 5/0525* (2013.01); *G03G 5/142* (2013.01); *G03G 5/144* (2013.01)

(58) Field of Classification Search
CPC ..... G03G 5/0525; G03G 5/142; G03G 5/144; G03G 5/14
USPC ..... 430/131, 60, 64
See application file for complete search history.

(56) References Cited

U.S. PATENT DOCUMENTS

| | | | | |
|---|---|---|---|---|
| 7,413,840 | B1 | 8/2008 | Ogaki et al. | |
| 7,629,102 | B2 | 12/2009 | Ochi et al. | |
| 2013/0244172 | A1 | 9/2013 | Sekiya et al. | |
| 2014/0154620 | A1 * | 6/2014 | Ito et al. ..... | 430/56 |

FOREIGN PATENT DOCUMENTS

| | | | |
|---|---|---|---|
| EP | 2 738 612 | A1 | 6/2014 |
| JP | 2010-113005 | A | 5/2010 |
| JP | 2011-95664 | A | 5/2011 |
| JP | 2012-128397 | A | 7/2012 |
| WO | 2012/070472 | A1 | 5/2012 |

OTHER PUBLICATIONS

Diamond, A.S., ed., Handbook of Imaging Materials, Marcel Dekker, Inc., NY (1991), pp. 395-396.*
European Search Report dated Oct. 30, 2014 in European Application No. 14002090.0.
Yamashita, et al. (eds.), "Crosslinking Agent Handbook", Taiseisha, Ltd., 1981, pp. 536-605.
Ogaki, et al., U.S. Appl. No. 14/359,272, filed May 19, 2014.
Okuda, et al., U.S. Appl. No. 14/353,463, filed Apr. 22, 2014.
Murakami, et al., U.S. Appl. No. 14/374,044, filed Jul. 23, 2014.
Okuda, et al., U.S. Appl. No. 14/304,172, filed Jun. 13, 2014.
Yamagishi, et al., U.S. Appl. No. 14/359,563, filed May 20, 2014.

* cited by examiner

*Primary Examiner* — Janis L Dote
(74) *Attorney, Agent, or Firm* — Fitzpatrick, Cella, Harper & Scinto

(57) ABSTRACT

Provided is a process for producing an electrophotographic photosensitive member, the process including the steps of: preparing a dispersion liquid by dispersing particles each containing an electron transporting substance in an aqueous dispersion medium; forming the coat of the dispersion liquid on the support; and forming an undercoat layer by heating the coat at a temperature equal to or more than the melting point of the electron transporting substance.

9 Claims, 1 Drawing Sheet

PROCESS FOR PRODUCING ELECTROPHOTOGRAPHIC PHOTOSENSITIVE MEMBER

BACKGROUND OF THE INVENTION

1. Field of the Invention

The present invention relates to a process for producing an electrophotographic photosensitive member.

2. Description of the Related Art

An electrophotographic photosensitive member containing an organic photoconductive substance (hereinafter referred to as "charge generating substance") is known as an electrophotographic photosensitive member to be mounted on an electrophotographic apparatus. At present, the above-mentioned electrophotographic photosensitive member has been a mainstream electrophotographic photosensitive member to be used in a process cartridge of an electrophotographic apparatus or in the electrophotographic apparatus, and has been put into large-scale production. Of such electrophotographic photosensitive members, a laminated electrophotographic photosensitive member improved in characteristics by separating functions needed for an electrophotographic photosensitive member into its respective layers has been frequently used. A construction obtained by laminating an undercoat layer, a charge generating layer, and a hole transporting layer in the stated order on a support has been adopted as a main construction of the laminated electrophotographic photosensitive member.

A method involving dissolving a functional material in an organic solvent to prepare an application solution (application liquid) and applying the solution onto the support has been generally employed as a method of producing the laminated electrophotographic photosensitive member. The reduction of the organic solvent in the step of forming a coat for each layer has been desired in recent years. Such a proposal as described below has been made in a layer in which a metal oxide has been dispersed or a layer in which an electron transporting substance has been dispersed as a proposal for the reduction of the organic solvent for the undercoat layer of the laminated electrophotographic photosensitive member.

Japanese Patent Application Laid-Open No. 2010-113005 proposes a method involving: forming a coat of a dispersion liquid obtained by dissolving a polyol-based resin and a blocked isocyanate compound in an aqueous dispersion medium, and dispersing metal oxide particles in the medium; and heating the coat to form an undercoat layer in which the metal oxide particles have been dispersed. Japanese Patent Application Laid-Open No. 2012-128397 proposes a method involving: producing a water dispersion liquid containing polyolefin resin particles and particles each containing an electron transporting substance; forming a coat of the dispersion liquid on a support; and forming an undercoat layer by heating the coat to melt the polyolefin resin particles. In Japanese Patent Application Laid-Open No. 2012-128397, the undercoat layer in which the particles each containing the electron transporting substance have been dispersed is formed.

Although the undercoat layer can be formed by using the aqueous dispersion medium in each of the methods disclosed in Japanese Patent Application Laid-Open No. 2010-113005 and Japanese Patent Application Laid-Open No. 2012-128397, an additional improvement in uniformity of the undercoat layer has been required for an additional improvement in image uniformity. In Japanese Patent Application Laid-Open No. 2010-113005, the metal oxide particles each functioning as an electron transporting substance need to be dispersed in an additionally uniform manner. However, it may be difficult to improve dispersibility of the metal oxide particles in the aqueous dispersion medium. In addition, the method disclosed in Japanese Patent Application Laid-Open No. 2012-128397 is a method of forming an undercoat layer in which the electron transporting substance has been dispersed in a state of particles each containing the electron transporting substance, and hence uniformity of a surface of the undercoat layer is liable to reduce. Therefore, a production method by which the organic solvent is reduced and the uniformity of the surface of the undercoat layer is improved upon formation of the undercoat layer has been desired.

SUMMARY OF THE INVENTION

An object of the present invention is to provide a process for producing an electrophotographic photosensitive member, in particular, a process for producing an electrophotographic photosensitive member having high image uniformity by which a usage of an organic solvent is reduced and uniformity of a surface of an undercoat layer is improved in the step of forming the undercoat layer.

The present invention relates to a process for producing an electrophotographic photosensitive member including a support, an undercoat layer formed on the support, a charge generating layer formed on the undercoat layer, and a hole transporting layer formed on the charge generating layer, the process including: preparing a dispersion liquid for an undercoat layer by dispersing particles each containing an electron transporting substance in an aqueous dispersion medium; forming a coat of the dispersion liquid on the support; and forming the undercoat layer by heating the coat at a temperature equal to or more than a melting point of the electron transporting substance.

The present invention also relates to a process for producing an electrophotographic photosensitive member including a support, an undercoat layer formed on the support, a charge generating layer formed on the undercoat layer, and a hole transporting layer formed on the charge generating layer, the process including: preparing a dispersion liquid for an undercoat layer by dispersing particles each containing an electron transporting substance in an aqueous dispersion medium; forming a coat of the dispersion liquid on the support; and forming the undercoat layer by heating the coat at a temperature equal to or more than a melting point of the electron transporting substance to melt the electron transporting substance.

According to one embodiment of the present invention, it is possible to provide the process for producing an electrophotographic photosensitive member having high image uniformity by which the usage of an organic solvent is reduced and the uniformity of the surface of an undercoat layer is improved.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A process for producing an electrophotographic photosensitive member of the present application includes the steps of: preparing a dispersion liquid for an undercoat layer by dispersing particles each containing an electron transporting substance in an aqueous dispersion medium; and forming a coat of the dispersion liquid on the support. The process includes, in addition to the two steps, the step of forming the undercoat layer by heating the coat at a temperature equal to or more than the melting point of the electron transporting substance. Alternatively, the process includes, in addition to the two steps, the step of forming the undercoat layer by heating the coat at a temperature equal to or more than the melting point of the electron transporting substance to melt the electron transporting substance.

Hereinafter, the process for producing an electrophotographic photosensitive member of the present application and materials constituting the electrophotographic photosensitive member are described. The electrophotographic photosensitive member of the present invention includes a support, an undercoat layer formed on the support, a charge generating layer formed on the undercoat layer, and a hole transporting layer formed on the charge generating layer.

Figure 2:
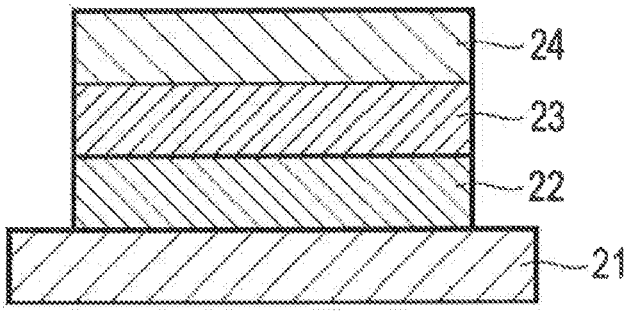
FIG. 2 is a view illustrating an example of the layer construction of an electrophotographic photosensitive member.

FIG. 2 is a view illustrating an example of the layer construction of the electrophotographic photosensitive member. In FIG. 2, the support is represented by reference numeral 21, the undercoat layer is represented by reference numeral 22, the charge generating layer is represented by reference numeral 23, and the hole transporting layer is represented by reference numeral 24.

Although a cylindrical electrophotographic photosensitive member obtained by forming a photosensitive layer (a charge generating layer or a hole transporting layer) on a cylindrical support has been widely used as a general electrophotographic photosensitive member, a shape such as a belt shape or a sheet shape can also be used.

[Undercoat Layer]

The electron transporting substance to be used for the undercoat layer is preferably an organic electron transporting substance. Examples of the electron transporting substance include an imide compound, a quinone compound, a benzimidazole compound, and a cyclopentadienylidene compound. Of those compounds, an imide compound or a quinone compound is preferred.

The imide compound is preferably a compound having a cyclic imide structure, and is preferably a compound represented by the following formula (1).

(1)

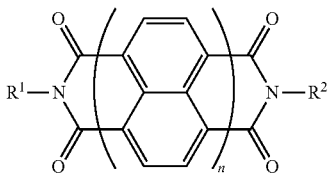

In the formula (1), $R^1$ and $R^2$ each independently represent a substituted or unsubstituted alkyl group, a substituted or unsubstituted phenyl group, or a substituted or unsubstituted pyridyl group. Examples of a substituent of the substituted alkyl group, a substituent of the substituted phenyl group, and a substituent of the substituted pyridyl group include an alkyl group, a haloalkyl group, a hydroxyalkyl group, a halogen atom, a hydroxy group, a carboxy group, a thiol group, an amino group, an alkoxy group, a cyano group, a nitro group, a phenyl group, and a phenylazenyl group. n represents the number of repetitions of a structure in parentheses, and represents 1 or 2.

The quinone compound is, for example, a compound having a para-quinoid structure or an ortho-quinoid structure. In addition, a compound having a structure in which aromatic rings are fused to each other is permitted, and a compound having a structure in which multiple quinoid structures are linked to each other is permitted. The quinone compound is preferably a compound represented by the following formula (2) or the following formula (3).

(2)

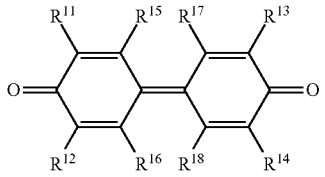

In the formula (2), $R^{11}$ to $R^{18}$ each independently represent a hydrogen atom, an alkyl group, or a divalent group represented by —CH═CH—CH═CH— formed by the bonding of adjacent groups represented by $R^{11}$ to $R^{18}$.

(3)

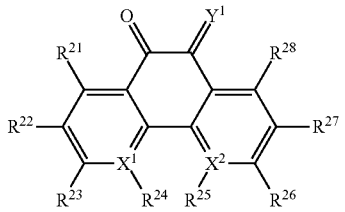

In the formula (3), $X^1$ and $X^2$ each independently represent a carbon atom or a nitrogen atom. $Y^1$ represents an oxygen atom or a dicyanomethylene group. $R^{21}$ to $R^{28}$ each independently represent a hydrogen atom, a halogen atom, a nitro group, a substituted or unsubstituted alkyl group, or a substituted or unsubstituted phenyl group. Examples of a substituent of the substituted alkyl group and a substituent of the substituted phenyl group include an alkyl group, a haloalkyl group, a halogen atom, a hydroxy group, a carboxy group, a thiol group, an amino group, a methoxy group, a nitro group, and a cyano group. In addition, when $X^1$ and $X^2$ each represent a nitrogen atom, none of $R^{24}$ and $R^{25}$ exists.

The benzimidazole compound is, for example, a compound having a benzimidazole ring structure. In addition, a compound having a structure in which aromatic rings are fused to each other is permitted. The benzimidazole compound is preferably a compound represented by the following formula (4), (5), or (6).

(4)

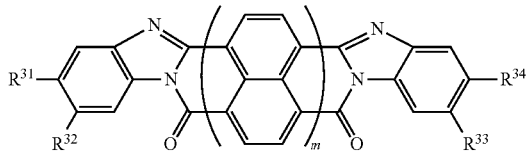

(5)

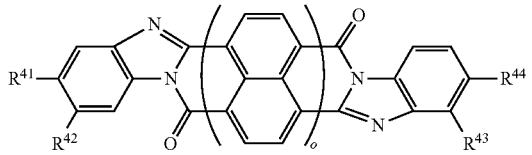

(6)

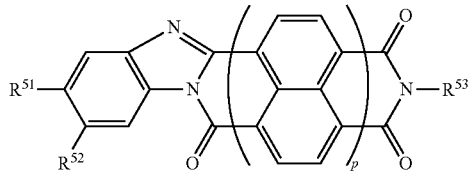

In the formula (4), $R^{31}$ to $R^{34}$ each independently represent a hydrogen atom, a halogen atom, or an alkyl group. m represents the number of repetitions of a structure in parentheses, and represents 1 or 2.

In the formula (5), $R^{41}$ to $R^{44}$ each independently represent a hydrogen atom, a halogen atom, or an alkyl group. o represents the number of repetitions of a structure in parentheses, and represents 1 or 2.

In the formula (6), $R^{51}$ and $R^{52}$ each independently represent a hydrogen atom, a halogen atom, a nitro group, or a substituted or unsubstituted alkyl group. $R^{53}$ represents a substituted or unsubstituted alkyl group, a substituted or unsubstituted phenyl group, or a substituted or unsubstituted naphthyl group. Examples of a substituent of the substituted alkyl group, a substituent of the substituted phenyl group, and a substituent of the substituted naphthyl group include an alkyl group, a hydroxyalkyl group, a haloalkyl group, a halogen atom, a hydroxy group, a carboxy group, a thiol group, an amino group, a methoxy group, a nitro group, and a cyano group. p represents the number of repetitions of a structure in parentheses, and represents 1 or 2.

The cyclopentadienylidene compound is, for example, a compound having a cyclopentadienylidene structure. In addition, a compound in which aromatic rings are fused to each other is permitted. The cyclopentadienylidene compound is preferably a compound represented by the following formula (7).

(7)

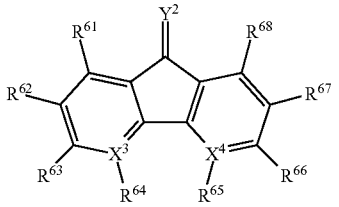

In the formula (7), $X^3$ and $X^4$ each independently represent a carbon atom or a nitrogen atom. $Y^2$ represents an oxygen atom, a dicyanomethylene group, or a substituted or unsubstituted phenylimino group. A substituent of the substituted phenylimino group is, for example, an alkyl group. $R^{61}$ to $R^{68}$ each independently represent a hydrogen atom, an alkoxycarbonyl group, or a nitro group. In addition, when $X^3$ and $X^4$ each represent a nitrogen atom, none of $R^{64}$ and $R^{65}$ exists.

The electron transporting substance is preferably a compound exhibiting poor solubility in the aqueous dispersion medium because of a reason to be described later. As an index of the electron transporting substance exhibiting poor solubility in the aqueous dispersion medium, the electron transporting substance satisfying the following condition is defined as being poorly soluble: when the aqueous dispersion medium and the particles each containing the electron transporting substance are mixed, the ratio of the particles to dissolve in the medium is 0.5 mass % or less.

The electron transporting substance in the present invention has a melting point of preferably 200° C. or less, more preferably 180° C. or less because of the reason to be described later.

The particles each containing the electron transporting substance in the present application are particles each containing at least one kind of electron transporting substance, and each particle may further contain any other substance in itself. Examples of the substance that may be incorporated into each particle in addition to the electron transporting substance include a resin, a crosslinking agent, and an additive.

Examples of the resin that may be incorporated into each particle containing the electron transporting substance include a butyral resin, an acetal resin, a polyol resin, a polyamide resin, a polystyrene resin, a polyacrylic resin, a polycarbonate resin, and a polyester resin. Of those resins, a butyral resin, an acetal resin, a polyol resin, or a polyamide resin is preferred.

Next, the crosslinking agent is described. For example, a compound described in "Crosslinking Agent Handbook" edited by Shinzo Yamashita and Tosuke Kaneko, and published by TAISEISHA LTD. (1981) can be used as the crosslinking agent in the present invention. Examples of the crosslinking agent that may be incorporated into each particle containing the electron transporting substance include an isocyanate compound and a blocked isocyanate compound.

Examples of the additive that may be incorporated into each particle containing the electron transporting substance include an antioxidant, a light stabilizer, and a metal catalyst.

In addition, the dispersion liquid obtained by dispersing the particles each containing the electron transporting substance in the aqueous dispersion medium may be produced by mixing particles containing different electron transporting substances. The dispersion liquid may be further mixed with particles each containing a resin, particles each containing a crosslinking agent, or particles each containing an additive in addition to the particles each containing the electron transporting substance to prepare a dispersion liquid.

Examples of the resin to be used for each particle containing the resin include a butyral resin, an acetal resin, a polyol resin, a polyamide resin, a polystyrene resin, a polyacrylic resin, a polycarbonate resin, and a polyester resin. Of those resins, a butyral resin, an acetal resin, a polyol resin, or a polyamide resin is preferred. Each particle containing the resin may further contain, for example, a crosslinking agent or an additive. Examples of the crosslinking agent include an isocyanate compound and a blocked isocyanate compound. Examples of the additive include an antioxidant, a light stabilizer, and a metal catalyst.

An existing particle production method can be employed as a method of producing the particles each containing the electron transporting substance. The particles each containing the resin, the particles each containing the crosslinking agent, and the particles each containing the additive can be similarly produced by employing the method of producing the particles each containing the electron transporting substance.

Hereinafter, a pulverizing method and a spray drying method are described as specific methods of producing the particles, but the production method is not limited thereto.

Although a method such as dry pulverization, wet pulverization, or freezing pulverization is available as the pulverizing method, a pulverizing method according to the material properties and kind of the electron transporting substance as a material from which the particles are to be produced can be selected. A pulverizer suitable for the pulverization of a soft material, an elastic material, or a resin-based material is desirable as a pulverizer, and examples thereof include an ultracentrifugal pulverizer, a rotor beater mill, a grind mix, and a mixer mill. In addition, when particles each containing the electron transporting substance, the resin, and the crosslinking agent are produced, or when particles each containing multiple kinds of electron transporting substances in itself are produced, the particles are produced by performing mixing treatment such as kneading before the treatment of the materials of interest with the pulverizer.

The spray drying method is a method called spray dry or spray drying, and is excellent because particles having high uniformity can be produced. The method is configured to involve: spraying a material dissolved or dispersed in a solvent or a dispersion medium; producing particles while removing the solvent or the dispersion medium; and collecting the particles with a cyclone.

The case where the particles each containing the electron transporting substance are produced by the spray drying method is described. When the particles each containing the electron transporting substance are produced, a solution containing the electron transporting substance is produced by dissolving the electron transporting substance in a solvent capable of dissolving the electron transporting substance. The concentration of the solution is preferably 2 to 15 mass % because the particles to be obtained can be reduced in particle diameter and can be produced with good uniformity. The particles each containing the electron transporting substance are produced by performing the spraying and drying of the solution with a spray drying apparatus. The particle diameter of each of the particles is preferably 2 to 15 μm in terms of thickness uniformity at the time of film formation. In addition, when particles each containing the electron transporting substance, the resin, and the crosslinking agent are produced, or when particles each containing multiple kinds of electron transporting substances in itself are produced, a solution is produced by dissolving these materials in a solvent capable of dissolving the materials. The concentration of the solution is preferably 2 to 15 mass % because particles having high uniformity are obtained at the stage of the production of the particles. The particles each containing the electron transporting substance, or the particles each containing the electron transporting substance, the resin, and the crosslinking agent are produced by performing the spraying and drying of the solution with a spray drying apparatus. The particle diameter of each of the particles is preferably 2 to 15 μm in terms of thickness uniformity at the time of film formation.

Next, the dispersion liquid containing the aqueous dispersion medium and the particles each containing the electron transporting substance is described.

The aqueous dispersion medium is a liquid in which the particles each containing the electron transporting substance can be dispersed and which can maintain the dispersed state of the particles. The expression "the dispersed state of the particles each containing the electron transporting substance can be maintained" means that the particles dispersed in the aqueous dispersion medium can maintain a state where neither coalescence nor bonding between the particles occurs.

A liquid exhibiting poor solubility for the particles each containing the electron transporting substance is used as the aqueous dispersion medium. When a mixture obtained by mixing the liquid exhibiting poor solubility for the particles each containing the electron transporting substance with another kind of liquid is used, its mixing amount is adjusted so that the aqueous dispersion medium mixed with the liquid may show poor solubility for the particles before the mixture is used as the aqueous dispersion medium. As an index of the liquid exhibiting poor solubility for the particles each containing the electron transporting substance, the liquid satisfying the following condition is defined as being poorly soluble: when the liquid and the particles are mixed, the ratio of the particles to dissolve in the liquid is 0.5 mass % or less.

The liquid exhibiting poor solubility for the particles each containing the electron transporting substance is preferably water, or an alcohol such as methanol or ethanol. The content of the liquid exhibiting poor solubility for the particles each containing the electron transporting substance in the total mass of the aqueous dispersion medium is preferably 60 mass % or more in terms of the maintenance of the dispersed state, and the content is more preferably 100 mass %.

The content of water in the aqueous dispersion medium is preferably 30 mass % or more with respect to the total mass of the aqueous dispersion medium in terms of the maintenance of the dispersed state. The content of water is more preferably 40 mass % or more, still more preferably mass % or more. When the aqueous dispersion medium contains methanol or ethanol, the total content of the content of water, and the content of at least one kind selected from the group consisting of methanol and ethanol is preferably 60 mass % or more with respect to the total mass of the aqueous dispersion medium.

With regard to the construction of the aqueous dispersion medium, the medium may contain a liquid except the liquid exhibiting poor solubility for the particles each containing the electron transporting substance to the extent that the dispersibility or dispersion stability of the particles is not impaired.

Examples of the liquid except the liquid exhibiting poor solubility include an ether liquid, an alcohol liquid having 3 or more carbon atoms, and a ketone liquid. Examples of the ether liquid include: a linear ether such as methoxymethane or dimethoxymethane; and a cyclic ether such as tetrahydrofuran or oxolane. Examples of the alcohol liquid having 3 or more carbon atoms include propanol and butanol. Examples of the ketone liquid include acetone and methyl ethyl ketone. Of those, an ether liquid is preferred from the viewpoint of maintaining the dispersibility of the particles each containing the electron transporting substance.

An existing dispersion method can be employed as a dispersion method for the preparation of the dispersion liquid of the present invention. Hereinafter, a stirring method and a high-pressure collision method are described as specific methods of dispersing the particles, but the dispersion method is not limited thereto.

The stirring method is described. The particles each containing the electron transporting substance and the aqueous dispersion medium are weighed and mixed. After that, the mixture is stirred with a stirring machine to provide the dispersion liquid. In addition, in the case of a dispersion liquid in which the particles each containing the resin, the particles each containing the crosslinking agent, and/or the particles each containing the additive are mixed in addition to the particles each containing the electron transporting substance, the respective particles are mixed and then stirred with the stirring machine to provide the dispersion liquid. The stirring machine is preferably a stirring machine capable of high-pressure stirring because the particles can be uniformly dispersed within a short time period. The stirring machine is, for example, a homogenizer.

The mass of the particles each containing the electron transporting substance in the dispersion liquid is preferably 10 to 40 mass % with respect to the mass of the dispersion liquid. When the mixture of the particles each containing the electron transporting substance and particles each containing any other material is used, a ratio between the respective particles (the particles each containing the electron transporting substance:particles each containing any other material) falls within the range of preferably from 4:10 to 20:10 (mass ratio), more preferably from 5:10 to 12:10 (mass ratio). The mixing amounts of the particles each containing the electron transporting substance and the particles each containing the other material are adjusted so that the ratio may be achieved.

Next, the high-pressure collision method is described. In the method, water (aqueous dispersion medium) is preferably used as a dispersion medium at the time of dispersion because the particles cannot be dispersed when the boiling point of the dispersion medium is low. After the dispersion liquid has been produced by using water, the liquid is mixed with any other liquid and the mixture is dispersed with a dispersing apparatus, whereby the dispersion liquid can be obtained. The dispersing apparatus is, for example, a microfluidizer.

The formation of the coat of the dispersion liquid in the present invention is described. Although an existing application method such as dip coating, spray coating, or ring coating can be employed as a method of forming the coat of the dispersion liquid, the dip coating is preferred from the viewpoint of productivity. The dispersion liquid is applied onto the support through the step, whereby the coat of the dispersion liquid can be formed.

Next, the step of forming the undercoat layer by heating the coat at a temperature equal to or more than the melting point of the electron transporting substance is described.

In the present application, the dispersion liquid containing the particles each containing the electron transporting substance is applied, and hence the surface of the undercoat layer needs to be uniformized by causing the electron transporting substance to uniformly exist in the undercoat layer simultaneously with the removal of the aqueous dispersion medium through heating.

In terms of the uniformization of the electron transporting substance, when the temperature at which the coat is heated is a temperature equal to or more than the melting point of the electron transporting substance in each particle containing the electron transporting substance, an undercoat layer having high uniformity can be formed. This is because of the following reason: the heating at a temperature equal to or more than the melting point of the electron transporting substance melts the electron transporting substance to eliminate a boundary surface between the particles, whereby the uniformity of the surface of the undercoat layer improves. That is, the foregoing shows that the uniformity of the surface of the undercoat layer can be improved by the presence of the step of heating the coat at a temperature equal to or more than the melting point of the electron transporting substance to melt the electron transporting substance.

In the case of a coat using a dispersion liquid containing particles each containing the resin and/or the crosslinking agent as well as the particles each containing the electron transporting substance, an undercoat layer is formed by heating the coat at a temperature equal to or more than the melting point of the electron transporting substance to dissolve the resin and/or the crosslinking agent in a molten product of the electron transporting substance. In addition, in the case of the coat of a dispersion liquid containing particles each further containing the resin and/or the crosslinking agent in the particles each containing the electron transporting substance as well, an undercoat layer is formed by heating the coat at a temperature equal to or more than the melting point of the electron transporting substance to dissolve the resin and/or the crosslinking agent in a molten product of the electron transporting substance. That is, the foregoing shows that the resin and/or the crosslinking agent are/is soluble in the molten product of the electron transporting substance at the temperature at which the coat is heated. The dissolution of the resin and/or the crosslinking agent in the molten product of the electron transporting substance eliminates a boundary surface between the particles containing the respective materials, whereby the uniformity of the surface of the undercoat layer improves. In addition, the content of the electron transporting substance to be incorporated into the undercoat layer is preferably large.

The temperature at which the coat is heated is preferably a temperature higher than the melting point of the electron transporting substance having the lowest melting point out of the electron transporting substances constituting the undercoat layer by 5° C. or more. In addition, when the temperature at which the coat is heated is excessively high, the denaturation and the like of the electron transporting substance occur. Accordingly, the temperature is preferably 200° C. or less, more preferably 180° C. or less.

The thickness of the undercoat layer of the electrophotographic photosensitive member to be produced by the production process of the present application is preferably 0.3 μm or more and 30 μm or less, more preferably 0.5 μm or more and 15 μm or less.

In the present application, the dispersion liquid containing the particles each containing the electron transporting substance is prepared, the dispersion liquid is applied onto the support to form the coat, and the coat is heated at a temperature equal to or more than the melting point of the electron transporting substance, whereby the following results are obtained: the usage of the organic solvent in the application liquid is reduced and the uniformity of the surface of the undercoat layer is improved.

In the method described in Japanese Patent Application Laid-Open No. 2010-113005, the metal oxide particles are used, and hence an improvement in dispersibility of the metal oxide particles in the aqueous medium and an improvement in uniformity of the surface of the undercoat layer may not be sufficient. In addition, it may be difficult to improve the uniformity in the step of heating the coat because heating at a temperature equal to or more than the melting point of the metal oxide particles is difficult.

The method described in Japanese Patent Application Laid-Open No. 2012-128397 is a method involving heating the coat of the application liquid to dissolve the resin incorporated into the coat. In the method, the electron transporting substance of the undercoat layer is present in a particle state in the undercoat layer, and hence the dispersion of the electron transporting substance in the undercoat layer may not be uniform and the uniformity of the surface of the undercoat layer may not be sufficient. In the present application, the uniformity of the surface of the undercoat layer can be improved probably because heating the coat of the dispersion liquid at a temperature equal to or more than the melting point of the electron transporting substance melts the electron transporting substance responsible for an electron transporting function to eliminate a boundary surface between the particles.

[Support]

The support is preferably conductive (conductive support). Examples thereof include aluminum and an aluminum alloy. In the case of a support made of aluminum or an aluminum alloy, the conductive support used may be an ED tube or an EI tube or one obtained by subjecting the support to cutting, electrolytic composite polish, or a wet- or dry-honing process. A further example thereof is a support made of a metal or a resin having formed thereon a thin film of a conductive material such as aluminum, an aluminum alloy, or an indium oxide-tin oxide alloy. A further example thereof is a support made of a metal or a resin having formed thereon a conductive layer including a resin in which conductive particles such as carbon black, tin oxide particles, titanium oxide particles, or silver particles are dispersed.

Further, in order to suppress an interference fringe, it is preferred to adequately make the surface of the support rough. Specifically, a support obtained by processing the surface of the above-mentioned support by honing, blast, cutting, or electrolytic polishing, or a support having a conductive layer which includes conductive particles and a resin on a support made of aluminum or an aluminum alloy is preferably used. In order to suppress generation of an interference fringe in an output image due to interference of light reflected on the surface of the conductive layer, a surface roughness-imparting agent for making the surface of the conductive layer rough may be added to the conductive layer.

[Conductive Layer]

In a method of forming a conductive layer having conductive particles and a resin on a support, powder containing the conductive particles is contained in the conductive layer. Examples of the conductive particles include carbon black, metal powders made of, for example, aluminum, nickel, iron, chromium, copper, zinc, and silver, and metal oxide powders made of, for example, conductive tin oxide and ITO. The conductive layer is a layer formed by forming a coat of an application liquid for a conductive layer, which is obtained by mixing conductive particles and a resin, and drying the resultant coat by heating.

Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin. Those resins may be used each alone or in combination of two or more kinds thereof.

The conductive layer may be formed by dip coating or solvent application using a Meyer bar or the like.

Examples of the solvent for the application liquid for a conductive layer include an ether-based solvent, an alcohol-based solvent, a ketone-based solvent, and an aromatic hydrocarbon solvent.

The thickness of the conductive layer is preferably 0.2 μm or more and 40 μm or less, more preferably 1 μm or more and 35 μm or less, still more preferably 5 μm or more and 30 μm or less.

[Undercoat Layer]

The undercoat layer is formed between the support or the conductive layer and the charge generating layer.

[Charge Generating Layer]

The charge generating layer is formed on the undercoat layer.

Examples of the charge generating substance (organic photoconductive substance) to be used in the charge generating layer include azo pigments, phthalocyanine pigments, indigo pigments, and perylene pigments. Only one kind of those charge generating substances may be used, or two or more kinds thereof may be used. Of those, oxytitanium phthalocyanine, hydroxygallium phthalocyanine, chlorogallium phthalocyanine, and the like are particularly preferred because of their high sensitivity.

Examples of the resin to be used in the charge generating layer include a polycarbonate resin, a polyester resin, a butyral resin, a polyvinylacetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge generating layer can be formed by forming a coat of an application liquid for a charge generating layer, which is prepared by dispersing a charge generating substance together with a resin and a solvent, and drying the resultant coat. Further, the charge generating layer may also be a deposited film of a charge generating substance.

Examples of the dispersion method include those using a homogenizer, an ultrasonic wave, a ball mill, a sand mill, an attritor, or a roll mill.

A ratio between the charge generating substance and the resin is preferably 0.1 part by mass or more and 10 parts by mass or less, particularly preferably 1 part by mass or more and 3 parts by mass or less of the charge generating substance with respect to 1 part by mass of the resin.

Examples of the solvent to be used in the application liquid for a charge generating layer include an alcohol-based solvent, a sulfoxide-based solvent, a ketone-based solvent, an ether-based solvent, an ester-based solvent, and an aromatic hydrocarbon solvent.

The thickness of the charge generating layer is preferably 0.01 μm or more and 5 μm or less, more preferably 0.1 μm or more and 2 μm or less.

Further, the charge generating layer may be added with any of various sensitizers, antioxidants, UV absorbents, plasticizers, and the like as required. An electron transporting substance or an electron accepting substance may also be incorporated into the charge generating layer to prevent the flow of charge from being disrupted in the charge generating layer.

[Hole Transporting Layer]

The hole transporting layer is formed on the charge generating layer. The hole transporting layer contains a hole transporting substance and a binder resin.

The hole transporting substance is a substance having a hole transporting ability, and examples thereof include a triarylamine compound, a hydrazone compound, a butadiene compound, and an enamine compound. Of those, a triarylamine compound is preferably used as the hole transporting substance in terms of improvements in electrophotographic characteristics. In addition, multiple kinds of hole transporting substances can be used as a mixture.

Examples of the binder resin include a polystyrene resin, a polyacrylic resin, a polycarbonate resin, and a polyester resin. Of those, a polycarbonate resin or a polyester resin is preferred. In addition, multiple kinds of binder resins can be used as a mixture.

In addition, an additive may be incorporated into the hole transporting layer in addition to the hole transporting substance and the binder resin. Specific examples of the additive include: a deterioration-preventing agent such as an antioxidant, a UV absorber, or a light stabilizer; and a resin for imparting releasability. Examples of the deterioration-preventing agent include a hindered phenol-based antioxidant, a hindered amine-based light stabilizer, a sulfur atom-containing antioxidant, and a phosphorus atom-containing antioxidant. Examples of the resin for imparting releasability include a fluorine atom-containing resin and a resin having a siloxane structure.

The hole transporting layer can be formed by forming a coat of an application liquid for a hole transporting layer, which is obtained by dissolving a hole transporting substance and a binder resin into a solvent, and drying the resultant coat.

A ratio between the hole transporting substance and the binder resin is preferably 0.4 part by mass or more and 2 parts by mass or less, more preferably 0.5 part by mass or more and 1.2 parts by mass or less of the hole transporting substance with respect to 1 part by mass of the binder resin.

Examples of the solvent to be used for the application liquid for a hole transporting layer include a ketone-based solvent, an ester-based solvent, an ether-based solvent, and an aromatic hydrocarbon solvent. Those solvents may be used each alone or as a mixture of two or more kinds thereof. Of those solvents, an ether-based solvent or an aromatic hydrocarbon solvent is preferably used from the viewpoint of the solubility of the binder resin.

The hole transporting layer has a thickness of preferably 5 μm or more and 50 μm or less, more preferably 10 μm or more and 35 μm or less.

For the application of each of the application liquids corresponding to the respective layers, any of the application methods can be employed, such as dip coating, spray coating, spinner coating, roller coating, Mayer bar coating, and blade coating.

[Electrophotographic Apparatus]

Figure 1:
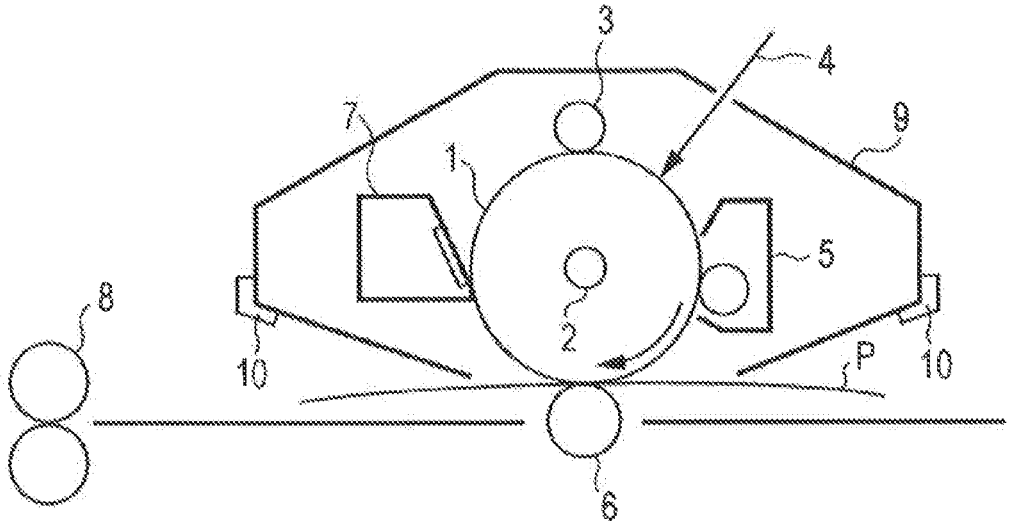
FIG. 1 is a view illustrating an example of the schematic construction of an electrophotographic apparatus including a process cartridge having an electrophotographic photosensitive member.

FIG. 1 illustrates an example of the schematic construction of an electrophotographic apparatus including a process cartridge including an electrophotographic photosensitive member.

In FIG. 1, a cylindrical electrophotographic photosensitive member 1 can be driven to rotate about an axis 2 in the direction indicated by the arrow at a predetermined peripheral speed. The surface of the electrophotographic photosensitive member 1 driven to rotate is uniformly charged at a predetermined positive or negative potential by a charging unit (primary charging unit: such as a charging roller) 3 during the process of rotation. Subsequently, the surface of the electrophotographic photosensitive member 1 receives exposure light (image exposure light) 4 which is emitted from an exposing unit (not shown) such as a slit exposure or a laser-beam scanning exposure and which is intensity-modulated according to a time-series electric digital image signal of image information of interest. In this way, electrostatic latent images corresponding to the image information of interest are sequentially formed on the surface of the electrophotographic photosensitive member 1.

The electrostatic latent images formed on the surface of the electrophotographic photosensitive member 1 are converted into toner images by reversal development with toner included in a developer of a developing unit 5. Subsequently, the toner images being formed and held on the surface of the electrophotographic photosensitive member 1 are sequentially transferred to a transfer material (such as paper) P by a transfer bias from a transferring unit (such as transfer roller) 6. It should be noted that the transfer material P is taken from a transfer material supplying unit (not shown) in synchronization with the rotation of the electrophotographic photosensitive member 1 and fed to a portion (contact part) between the electrophotographic photosensitive member 1 and the transferring unit 6. Further, a bias voltage having a polarity reverse to that of the electric charges of toner is applied to the transferring unit 6 from a bias power source (not shown).

The transfer material P which has received the transfer of the toner images is dissociated from the surface of the electrophotographic photosensitive member 1 and then introduced to a fixing unit 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the remaining developer (remaining toner) after the transfer by a cleaning unit (such as cleaning blade) 7. Subsequently, the surface of the electrophotographic photosensitive member 1 is subjected to a neutralization process with pre-exposure light (not shown) from a pre-exposing unit (not shown) and then repeatedly used in image formation. It should be noted that as illustrated in FIG. 1, when the charging unit 3 is a contact-charging unit using a charging roller and the like, the pre-exposure is not always required.

Of the structural components including the electrophotographic photosensitive member 1, the charging unit 3, the developing unit 5, the transferring unit 6, and the cleaning unit 7 as described above, a plurality of them may be selected and housed in a container and integrally supported as a process cartridge. In addition, the process cartridge may be designed so as to be detachably mountable to the main body of an electrophotographic apparatus such as a copying machine or a laser beam printer. In FIG. 1, the electrophotographic photosensitive member 1, the charging unit 3, the developing unit 5, and the cleaning unit 7 are integrally supported and placed in a cartridge, thereby forming a process cartridge 9. The process cartridge 9 is detachably mountable to the main body of the electrophotographic apparatus using a guiding unit 10 such as a rail of the main body of the electrophotographic apparatus.

EXAMPLES

Hereinafter, the present invention is specifically described by way of Dispersion Liquid Production Examples and Examples. However, the present invention is not limited thereto. It should be noted that "part(s)" means "part(s) by mass" in Examples.

[Dispersion Liquid Production Example 1]

A dispersion liquid containing particles each containing an electron transporting substance was produced by the following method.

100 Parts of a compound represented by the following formula (1-1) (melting point: 160 to 162° C.) as the electron transporting substance were dissolved in 900 parts of tetrahydrofuran to prepare a tetrahydrofuran solution. The resultant tetrahydrofuran solution was turned into particles with a Mini Spray Dryer B-290 to which an Inert Loop B-295 had been connected (both manufactured by BUCHI) by a spray dry method while the solvent was recovered in a stream of nitrogen. The settings of a nitrogen gas flow rate, an inlet temperature, an aspirator, and a pump were adjusted so that the particle diameter of each particle containing the electron transporting substance to be obtained became 2 to 10 μm. Thus, the particles each containing the electron transporting substance were produced.

(1-1)

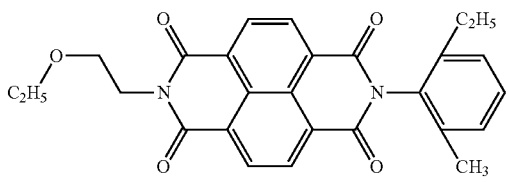

Next, 20 parts of N-methoxymethylated nylon as a resin were dissolved in 980 parts of methanol to prepare a methanol solution. The methanol solution containing the resin was turned into particles by the spray dry method described above. The settings of the nitrogen gas flow rate, the inlet temperature, the aspirator, and the pump were adjusted so that the particle diameter of each particle containing the resin to be obtained became 2 to 10 μm. Thus, particles each containing the resin were produced.

Next, 20 parts of the particles each containing the electron transporting substance and 10 parts of the particles each containing the resin as solid matter, and 56 parts of water and 24 parts of methanol (water/methanol=7/3) as an aqueous dispersion medium were weighed and mixed. The mixed liquid was stirred with a homogenizer under the condition of 5,000 rotations/min for 20 minutes. Thus, the dispersion liquid obtained by dispersing the particles each containing the electron transporting substance and the particles each containing the resin in the aqueous dispersion medium was obtained.

[Dispersion Liquid Production Example 2]

A dispersion liquid was produced by the same method as that of Dispersion Liquid Production Example 1 except that: the electron transporting substance described in Dispersion Liquid Production Example 1 was changed to a compound represented by the following formula (2-1) (melting point: 180 to 181° C.); and methanol in the aqueous dispersion medium was changed to ethanol.

(2-1)

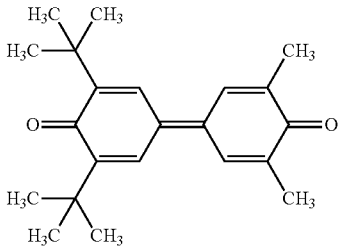

[Dispersion Liquid Production Example 3]

A dispersion liquid was produced by the same method as that of Dispersion Liquid Production Example 1 except that the electron transporting substance described in Dispersion Liquid Production Example 1 was changed to a compound represented by the following formula (1-2) (melting point: 120 to 122° C.)

(1-2)

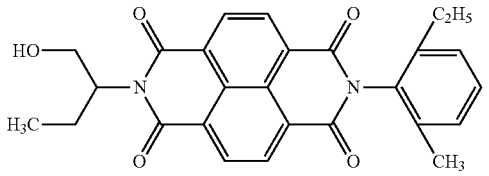

[Dispersion Liquid Production Example 4]

Particles each containing an electron transporting substance were produced by the same particle production method while the electron transporting substance described in Dispersion Liquid Production Example 1 was changed to the compound represented by the formula (1-2). In addition, the resin was changed to a butyral resin (product name: BM-1, degree of butyralization: about 65 mol %, hydroxyl group: about 34 mol %, manufactured by SEKISUI CHEMICAL CO., LTD.), 5 parts of a blocked isocyanate compound (product name: BWD-102, manufactured by Nippon Polyurethane Industry Co., Ltd.) were added to the resin, and 0.2 part of dibutyltin dilaurate was added to the mixture to produce particles each containing the resin and the crosslinking agent. A dispersion liquid was produced by the same method as that of Dispersion Liquid Production Example 1 except that the particles each containing the electron transporting substance, and the particles each containing the resin and the crosslinking agent were used.

[Dispersion Liquid Production Example 5]

Particles each containing an electron transporting substance were produced by the same particle production method while the electron transporting substance described in Dispersion Liquid Production Example 1 was changed to the compound represented by the formula (1-2). In addition, the resin was changed to an acetal resin (product name: BX-1, degree of acetalization: about 66 mol %, hydroxyl group: about 33 mol %, manufactured by SEKISUI CHEMICAL CO., LTD.), 5 parts of the blocked isocyanate compound (product name: BWD-102, manufactured by Nippon Polyurethane Industry Co., Ltd.) were added to the resin, and 0.2 part of dibutyltin dilaurate was added to the mixture to produce particles each containing the resin and the crosslinking agent. A dispersion liquid was produced by the same method as that of Dispersion Liquid Production Example 1 except that the particles each containing the electron transporting substance, and the particles each containing the resin and the crosslinking agent were used.

[Dispersion Liquid Production Example 6]

60 Parts of the compound represented by the formula (1-2) as the electron transporting substance, 20 parts of the butyral resin (product name: BM-1), 10 parts of the blocked isocyanate compound (product name: BWD-102), and 0.2 part of dibutyltin dilaurate were dissolved in 900 parts of tetrahydrofuran to prepare a tetrahydrofuran solution. The resultant tetrahydrofuran solution was turned into particles with a Mini Spray Dryer B-290 to which an Inert Loop B-295 had been connected (both manufactured by BUCHI) by a spray dry method while the solvent was recovered in a stream of nitrogen. The settings of the nitrogen gas flow rate, the inlet temperature, the aspirator, and the pump were adjusted so that the particle diameter of each particle containing the electron transporting substance, the resin, and the crosslinking agent to be obtained became 2 to 10 μm. Thus, the particles each containing the electron transporting substance, the resin, and the crosslinking agent were produced.

[Dispersion Liquid Production Example 7]

A dispersion liquid was produced by the same method as that of Dispersion Liquid Production Example 6 except that the resin described in Dispersion Liquid Production Example 6 was changed to an acetal resin (product name: BX-1, degree of acetalization: about 66 mol %, hydroxyl group: about 33 mol %, manufactured by SEKISUI CHEMICAL CO., LTD.).

Example 1

An aluminum cylinder having a diameter of 24 mm and a length of 257 mm was used as a support (conductive support).

Next, 10 parts of $SnO_2$-coated barium sulfate (conductive particle), 2 parts of titanium oxide (pigment for controlling resistance), 6 parts of a phenol resin, and 0.001 part of silicone oil (leveling agent) were mixed with a mixed solvent of 4 parts of methanol and 16 parts of methoxypropanol, to thereby prepare an application liquid for a conductive layer. The application liquid for a conductive layer was applied onto the support by dip coating to form a coat, and the resultant coat was heated at 140° C. for 30 minutes to form a conductive layer having a thickness of 20 μm.

Next, the dispersion liquid produced in Dispersion Liquid Production Example 1 was applied onto the conductive layer by dip coating to form a coat. The step of heating the resultant coat at 200° C. for 60 minutes was performed to form an undercoat layer having a thickness of 1 μm. The step of heating at 200° C. is the step of heating the coat at 200° C. to melt the electron transporting substance.

Next, 10 parts of a hydroxygallium phthalocyanine crystal (having peaks at Bragg angles)(2θ±0.2° of 7.5°, 9.9°, 16.3°, 18.6°, 25.1°, and 28.3° in CuKα characteristic X-ray diffraction) as a charge generating substance were added to a solution obtained by dissolving 5 parts of an acetal resin (trade name: S-LEC BX-1, manufactured by SEKISUI CHEMICAL CO., LTD.) in 250 parts of cyclohexanone. The resultant mixture was dispersed by a sand mill apparatus using glass beads each having a diameter of 1 mm under a 23±3° C. atmosphere for 1 hour. After the dispersion, 250 parts of ethyl acetate were added to prepare an application liquid for a charge generating-layer. The application liquid for a charge generating layer was applied onto the undercoat layer by dip coating to form a coat, and the resultant coat was dried at 100° C. for 10 minutes to form a charge generating layer having a thickness of 0.26 μm.

Next, 9 parts of a hole transporting substance represented by the following formula (CTM-1), 1 part of a hole transporting substance represented by the following formula (CTM-2), and 10 parts of a polycarbonate resin (Iupilon Z-400, Mitsubishi Engineering-Plastics Corporation, viscosity-average molecular weight (Mv): 40,000) as a binder resin were dissolved in a mixed solvent of 65 parts of ortho-xylene and 35 parts of dimethoxymethane to prepare an application liquid for a hole transporting layer. The application liquid for a hole transporting layer was applied onto the charge generating layer by dip coating to form a coat, and the resultant coat was dried by heating at 120° C. for 60 minutes. Thus, a hole transporting layer having an average thickness at a position distant from the upper end in the longitudinal direction of the cylindrical support by 120 mm of 20 μm was formed.

(CTM-1)

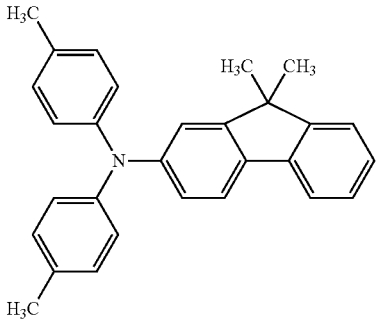

(CTM-2)

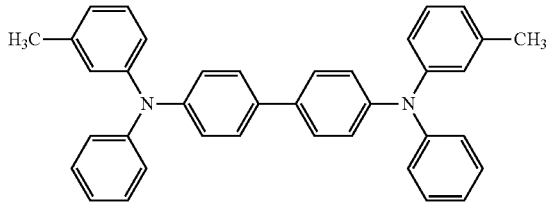

An electrophotographic photosensitive member employing the production process of the present invention was produced by the foregoing method. Next, its evaluations are described.

<Evaluation for Uniformity of Surface of Undercoat Layer>

The surface of the cylindrical support (electrophotographic photosensitive member) at the position distant from the upper end portion in the longitudinal direction by 120 mm was measured for its surface roughness with a surface roughness measuring device (Surfcorder SE-3400, manufactured by Kosaka Laboratory Ltd.). The measurement of the surface roughness was an evaluation (evaluation length: 10 mm) performed based on a ten-point average roughness (Rzjis) evaluation in JIS B 0601:2001. Table 1-1 shows the result.

<Image Evaluation>

An image evaluation was performed by using the produced electrophotographic photosensitive member in a laser beam printer LBP-2510 manufactured by Canon Inc. In the image evaluation, a 780 nm laser light source was reconstructed in terms of its exposure value (image exposure value) so that a light quantity on the surface of the electrophotographic photosensitive member became 0.3 $\mu J/cm^2$. In addition, the evaluation was performed under an environment having a temperature of 23° C. and a humidity of 15%. The image evaluation was performed as follows: a monochromatic halftone image was output on A4 size plain paper and the output image was visually evaluated by the following criteria. Rank A and Rank B were each defined as the level at which the effect of the present invention was obtained.

Rank A: An entirely uniform image is obtained.

Rank B: Slight image unevenness is present in a small fraction of the image.

Rank C: Image unevenness is present.

Rank D: Conspicuous image unevenness is present. Table 1-1 shows the result.

Examples 2 to 33

Electrophotographic photosensitive members were each produced by the same method as that of Example 1 except that: an undercoat layer was formed by using a dispersion liquid described in Table 1-1 and Table 1-2; and the conditions under which the coat of the dispersion liquid was heated were changed as described in Table 1-1 and Table 1-2. Their evaluations were also performed by the same methods as those of Example 1. Table 1-1 and Table 1-2 show the results.

Comparative Examples 1 to 5

Electrophotographic photosensitive members were each produced by the same method as that of Example 1 except that: an undercoat layer was formed by using a dispersion liquid described in Table 1-2; and the conditions under which the coat of the dispersion liquid was heated were changed as described in Table 1-2. Their evaluations were also performed by the same methods as those of Example 1. Table 1-2 shows the results.

Comparative Example 6

An electrophotographic photosensitive member was produced and evaluated by the same methods as those of Example 1 except that an undercoat layer was formed as described below. Table 1-2 shows the results.

12 Parts of zinc oxide fine particles (product name: MZ300, manufactured by TAYCA CORPORATION), 9 parts of a water-soluble nylon (product name: TORESIN FS-350, manufactured by Nagase ChemteX Corporation), and 14 parts of a blocked isocyanate compound (product name: TAKENATE WB-820 manufactured by Mitsui Chemicals Polyurethane) were mixed in 65 parts of water, and the mixture was stirred to produce a comparative dispersion liquid 1 as an application liquid for an undercoat layer. The resultant comparative dispersion liquid 1 was applied onto the conductive layer by dip coating to form a coat. The step of heating the resultant coat at 180° C. for 60 minutes was performed to form an undercoat layer having a thickness of 1 μm.

Comparative Example 7

An electrophotographic photosensitive member was produced and evaluated by the same methods as those of Example 1 except that an undercoat layer was formed as described below. Table 1-2 shows the results.

A comparative dispersion liquid 2 was produced by the same method as that of Dispersion Liquid Production Example 1 except that the resin described in Dispersion Liquid Production Example 1 was changed to a polyolefin resin (product name: BONDINE HX-8290, manufactured by Sumitomo Chemical Company, Limited). The resultant comparative dispersion liquid 2 was applied onto the conductive layer by dip coating to form a coat. The step of heating the resultant coat at 100° C. for 30 minutes was performed to form an undercoat layer having a thickness of 1 μm.

TABLE 1-1

| | | Heating condition | | Evaluation for | |
|---|---|---|---|---|---|
| | Dispersion liquid | Heating temperature [° C.] | Heating time [min] | uniformity [μm] | Image evaluation |
| Example 1 | Dispersion Liquid Production Example 1 | 200 | 60 | 0.50 | A |
| Example 2 | Dispersion Liquid Production Example 1 | 180 | 60 | 0.48 | A |
| Example 3 | Dispersion Liquid Production Example 1 | 180 | 40 | 0.48 | A |
| Example 4 | Dispersion Liquid Production Example 1 | 165 | 60 | 0.56 | A |
| Example 5 | Dispersion Liquid Production Example 2 | 220 | 60 | 0.52 | A |
| Example 6 | Dispersion Liquid Production Example 2 | 200 | 60 | 0.55 | A |
| Example 7 | Dispersion Liquid Production Example 2 | 185 | 60 | 0.62 | B |
| Example 8 | Dispersion Liquid Production Example 3 | 180 | 60 | 0.48 | A |
| Example 9 | Dispersion Liquid Production Example 3 | 160 | 60 | 0.52 | A |
| Example 10 | Dispersion Liquid Production Example 3 | 160 | 40 | 0.54 | A |
| Example 11 | Dispersion Liquid Production Example 3 | 160 | 20 | 0.56 | A |
| Example 12 | Dispersion Liquid Production Example 3 | 140 | 60 | 0.52 | A |
| Example 13 | Dispersion Liquid Production Example 3 | 140 | 40 | 0.55 | A |
| Example 14 | Dispersion Liquid Production Example 4 | 180 | 60 | 0.48 | A |
| Example 15 | Dispersion Liquid Production Example 4 | 160 | 60 | 0.48 | A |
| Example 16 | Dispersion Liquid Production Example 4 | 160 | 40 | 0.49 | A |
| Example 17 | Dispersion Liquid Production Example 4 | 140 | 60 | 0.49 | A |
| Example 18 | Dispersion Liquid Production Example 4 | 140 | 40 | 0.51 | A |

TABLE 1-2

| | | Heating condition | | Evaluation for | |
|---|---|---|---|---|---|
| | Dispersion liquid | Heating temperature [° C.] | Heating time [min] | uniformity [μm] | Image evaluation |
| Example 19 | Dispersion Liquid Production Example 5 | 180 | 60 | 0.49 | A |
| Example 20 | Dispersion Liquid Production Example 5 | 160 | 60 | 0.49 | A |
| Example 21 | Dispersion Liquid Production Example 5 | 160 | 40 | 0.50 | A |
| Example 22 | Dispersion Liquid Production Example 5 | 140 | 60 | 0.50 | A |

TABLE 1-2-continued

| | Dispersion liquid | Heating condition: Heating temperature [° C.] | Heating condition: Heating time [min] | Evaluation for uniformity [μm] | Evaluation for Image evaluation |
|---|---|---|---|---|---|
| Example 23 | Dispersion Liquid Production Example 5 | 140 | 40 | 0.52 | A |
| Example 24 | Dispersion Liquid Production Example 6 | 180 | 60 | 0.45 | A |
| Example 25 | Dispersion Liquid Production Example 6 | 160 | 60 | 0.45 | A |
| Example 26 | Dispersion Liquid Production Example 6 | 160 | 40 | 0.46 | A |
| Example 27 | Dispersion Liquid Production Example 6 | 140 | 60 | 0.46 | A |
| Example 28 | Dispersion Liquid Production Example 6 | 140 | 40 | 0.48 | A |
| Example 29 | Dispersion Liquid Production Example 7 | 180 | 60 | 0.45 | A |
| Example 30 | Dispersion Liquid Production Example 7 | 160 | 60 | 0.45 | A |
| Example 31 | Dispersion Liquid Production Example 7 | 160 | 40 | 0.46 | A |
| Example 32 | Dispersion Liquid Production Example 7 | 140 | 60 | 0.46 | A |
| Example 33 | Dispersion Liquid Production Example 7 | 140 | 40 | 0.48 | A |
| Comparative Example 1 | Dispersion Liquid Production Example 1 | 120 | 60 | 0.73 | C |
| Comparative Example 2 | Dispersion Liquid Production Example 2 | 160 | 60 | 0.78 | C |
| Comparative Example 3 | Dispersion Liquid Production Example 3 | 100 | 60 | 0.75 | C |
| Comparative Example 4 | Dispersion Liquid Production Example 4 | 100 | 60 | 0.72 | C |
| Comparative Example 5 | Dispersion Liquid Production Example 6 | 100 | 60 | 0.72 | C |
| Comparative Example 6 | Comparative dispersion liquid 1 | 180 | 60 | 1.45 | D |
| Comparative Example 7 | Comparative dispersion liquid 2 | 100 | 30 | 0.73 | C |

As can be seen from comparison between Examples and Comparative Examples 1 to 5, the following result has been obtained: in the case where the temperature at which the coat of a dispersion liquid is heated is a temperature equal to or more than the melting point of the electron transporting substance in the coat, an undercoat layer having high uniformity of its surface can be formed. The result may originate from the phenomenon in which the electron transporting substance melts when the coat is heated at a temperature higher than the melting point of the electron transporting substance in each particle. The phenomenon may eliminate a boundary surface between particles to improve the uniformity of the surface of the undercoat layer. In addition, in the case where a resin or a crosslinking agent is present in the dispersion liquid, the following phenomenon may occur: when the coat is heated at a temperature higher than the melting point of the electron transporting substance in each particle, the electron transporting substance melts, and the resin or the crosslinking agent dissolves in the molten product of the electron transporting substance. The phenomenon may melt the boundary surface between the particles, or dissolve the boundary surface in the molten product, to eliminate the boundary surface, thereby improving the uniformity of the surface of the undercoat layer. Further, it has been shown that an undercoat layer having high uniformity can be formed within a short time period by heating the coat at a temperature higher than the melting point of the electron transporting substance by 5° C. or more.

As can be seen from comparison between Examples and Comparative Example 6, the following result has been obtained: in the case where the metal oxide particles are used, the uniformity of the surface of the undercoat layer is lower than that of each of Examples because it is difficult to heat the coat at a temperature equal to or more than the melting point of the metal oxide particles. In addition, as can be seen from comparison between Examples and Comparative Example 7, the following result has been shown: the uniformity of the surface of the undercoat layer is improved by heating the coat at a temperature equal to or more than the melting point of the electron transporting substance like Examples.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-128287, filed Jun. 19, 2013, which is hereby incorporated by reference herein in its entirety.

What is claimed is:

1. A process for producing an electrophotographic photosensitive member including an electrically conductive support, an undercoat layer formed on the support, a charge generating layer formed on the undercoat layer, and a hole transporting layer formed on the charge generating layer, the process comprising:

preparing one of dispersion liquids described in the following (i) and the following (ii), for the undercoat layer:

(i) a dispersion liquid obtained by dispersing particles each containing an electron transporting substance, and particles each containing at least one of a resin or a crosslinking agent in the aqueous dispersion medium, and (ii) a dispersion liquid obtained by dispersing particles each containing the electron transporting substance and at least one of the resin or the crosslinking agent in the aqueous dispersion medium;

forming a coat of the dispersion liquid on the support; and forming the undercoat layer by heating the coat at a temperature equal to or more than a melting point of the electron transporting substance, wherein at least one of the resin or the crosslinking agent is soluble in a molten product of the electron transporting substance at the temperature at which the coat is heated.

2. A process for producing an electrophotographic photosensitive member according to claim 1, wherein the resin comprises at least one selected from the group consisting of a polyamide resin, a butyral resin, and an acetal resin.

3. A process for producing an electrophotographic photosensitive member according to claim 1, wherein the crosslinking agent comprises at least one selected from the group consisting of an isocyanate compound and a blocked isocyanate compound.

4. A process for producing an electrophotographic photosensitive member according to claim 1, wherein a content of water in the aqueous dispersion medium is 30 mass % or more with respect to a total mass of the aqueous dispersion medium.

5. A process for producing an electrophotographic photosensitive member according to claim 4, wherein the aqueous dispersion medium further contains at least one selected from the group consisting of methanol and ethanol.

6. A process for producing an electrophotographic photosensitive member according to claim 5, wherein a total content of the content of the water and a content of at least one selected from the group consisting of the methanol and the ethanol in the aqueous dispersion medium is 60 mass % or more with respect to the total mass of the aqueous dispersion medium.

7. A process for producing an electrophotographic photosensitive member according to claim 6, wherein the total content of the content of the water and a content of at least one selected from the group consisting of the methanol and the ethanol in the aqueous dispersion medium is 100 mass % with respect to the total mass of the aqueous dispersion medium.

8. A process for producing an electrophotographic photosensitive member according to claim 1, wherein the electron transporting substance comprises at least one selected from the group consisting of an imide compound and a quinone compound.

9. A process for producing an electrophotographic photosensitive member according to claim 1, wherein the temperature at which the coat is heated is 200° C. or less.

* * * * *